United States Patent [19]

Anstett

[11] 4,388,733

[45] Jun. 21, 1983

[54] PROTECTIVE BUTCHERS GLOVE

[76] Inventor: Maurice Anstett, 414 Wellington St. N., Kitchener, Ontario, Canada, N2H 5L2

[21] Appl. No.: 268,653

[22] Filed: May 29, 1981

[51] Int. Cl.[3] ..... A41D 19/00

[52] U.S. Cl. ..... 2/161 R; 2/162; 2/167

[58] Field of Search ..... 2/16, 160, 161 R, 161, 2/162, 167, 170

[56] References Cited

U.S. PATENT DOCUMENTS

| | | | |
|---|---|---|---|
| 605,505 | 6/1898 | Murray | 2/161 R |
| 1,594,151 | 7/1926 | Chance | 2/161 R |
| 1,736,928 | 11/1929 | Lowe | 2/167 |
| 1,794,167 | 2/1931 | Gillian | 2/161 R |
| 2,041,201 | 5/1936 | Neback | 2/161 R |
| 2,096,412 | 10/1937 | Sturm | 2/161 R |
| 2,448,697 | 9/1948 | Bakke | 2/161 R |
| 2,862,208 | 12/1958 | Castro | 2/161 R |
| 3,883,898 | 5/1975 | Byrnes | 2/167 |
| 4,004,295 | 6/1977 | Byrnes | 2/161 R |

*Primary Examiner*—Louis Rimrodt

[57] ABSTRACT

A chain mesh protective glove for butchers has a semi rigid wrist guard configured to shield an area extending no more than halfway around a user's forearm nearest the wrist joint, including the front of the wrist and the base of the thumb. A flexible wristband connects the wrist guard to the glove and secures the glove around a wearer's wrist. When the glove is used in conjunction with a conventional protective sleeve, the wrist guard provides protection against knife penetration between the glove and the sleeve, without significantly impairing articulation of the user's wrist.

5 Claims, 2 Drawing Figures

PROTECTIVE BUTCHERS GLOVE

This invention relates to safety gloves of the type worn by butchers and meat cutters in meat packing plants to protect that hand, usually the left, which holds a carcass from accidental cuts inflicted by a knife held in the other hand.

Such gloves have been used for a number of years and are of chain mesh, typically of stainless steel, and usually worn in conjunction with under and over gloves. Formerly, such gloves only covered the thumb and the first one or two fingers because of the high cost and weight of the chain mesh, but full gloves are coming into more general use, and are now usually worn in conjunction with a protective gauntlet, such as a sleeve moulded from acrylic plastics material, which protects the forearm.

Even with such protection, it is found that accidents still occasionally occur when the knife slips after glancing off bone or a frozen portion of the carcass and penetrates between the glove and the gauntlet at the wrist, slashing the wrist or lower front of the forearm. Extension of the gloves mesh beyond the wrist to prevent this problem, as in U.S. Pat. No. 1,736,928 of Lowe, would substantially increase the costs and weight of the glove, as well as making it more difficult to put on and introducing possible comfort problems, and any form of direct coupling between the glove and the gauntlet sufficient to prevent knife penetration would tend both to interfere with free wrist movement and make the assembly awkward to put on.

In U.S. Pat. No. 2,862,208 (Castro), reinforcing chains in a protective glove are extended into a gauntlet so as to extend the area protected beyond the wrist. The glove is however intended to protect the hand, usually the left, that holds sugar cane during cutting, the protection required being against cross strokes directed to the back and side of the wrist. The Castro arrangement applied to a butcher's glove would protect the wrong part of the wrist and even if differently located would provide only very limited protection against penetration of the end of the knife beneath a gauntlet since the knife could pass between the chains.

U.S. Pat. Nos. 3,883,898 and 4,004,295 of Byrnes relate to butcher's gloves woven from high tensile aramid fibre or fibre with metal reinforcement, which gloves include gauntlets. However, these patents provide no teaching which is helpful in improving the metallic chain mesh gloves whose excellent flexibility and high resistance both to cutting and penetration renders them generally favoured in the industry. Aramid fibre textiles on the other hand present the problem that the very properties that make them resistant to penetration also reduce their flexibility, and thus make gauntlet extensions less acceptable.

SUMMARY OF THE INVENTION

The object of the present invention is to provide means to extend past the wrist the protection afforded by conventional chain mesh butcher's gloves without unduly increasing either the cost or weight of the glove, without unduly hampering wrist movement and without making the glove significantly more difficult or uncomfortable to put on and wear.

Accordingly the invention provides a protective glove for butchers, comprising a chain mesh glove portion configured to cover at least the thumb and index finger of a wearer's hand, a semi-rigid wrist guard configured to shield the area extending not substantially more than half way around a user's forearm proximate the wrist joint, the shielded area including the front of the wrist and the area beneath the base of the thumb, and a flexible wrist band which both connects the wrist guard to the glove portion in overlapping relationship and is adapted to secure the glove around the wearer's wrist.

In a preferred arranged, the wrist band is of elastomeric material vulcanized to both the glove portion and to the wrist guard, the wrist guard being of rubberized fibre sheet moulded to the shape of the forearm area to be protected.

Further features of the invention will become apparent from a description of a preferred embodiment of the invention with reference to the accompanying drawings.

SHORT DESCRIPTION OF THE DRAWINGS

In the drawings:

FIG. 1 is a perspective view, partially broken away for clarity, showing a glove in accordance with the invention as normally worn in conjunction with a separately formed rigid guantlet, and FIG. 2 is a perspective frontal view of the glove when not in use.

DESCRIPTION OF THE PREFERRED EMBODIMENT

Figure 1:
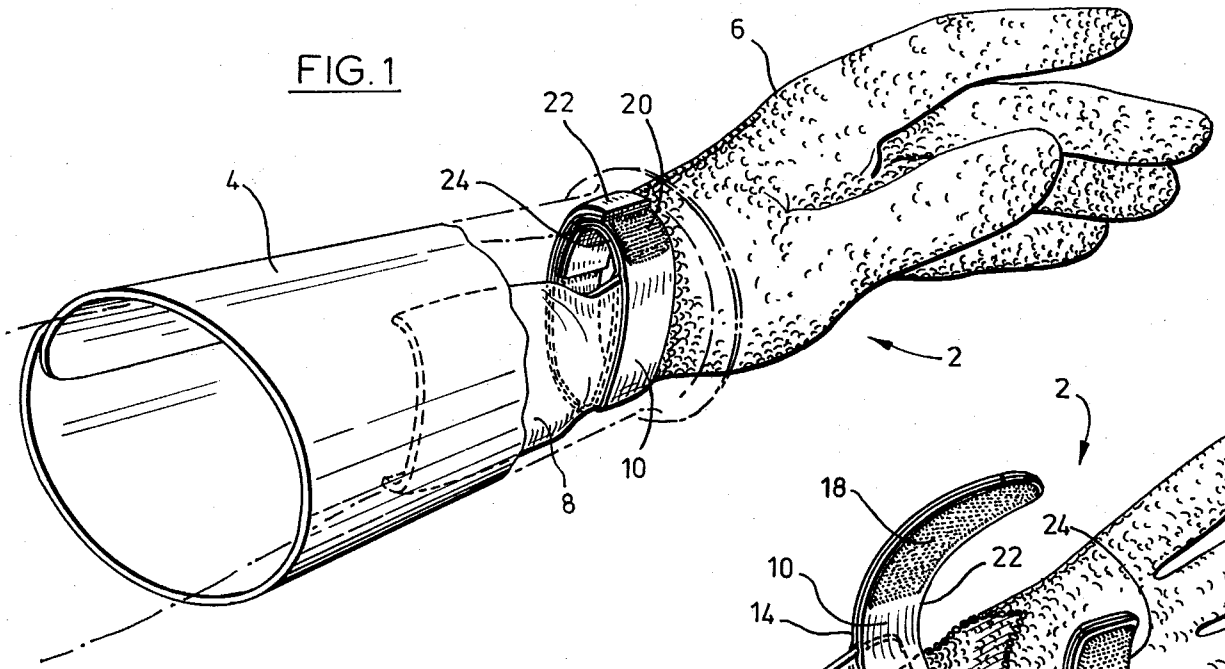
Figure 2:
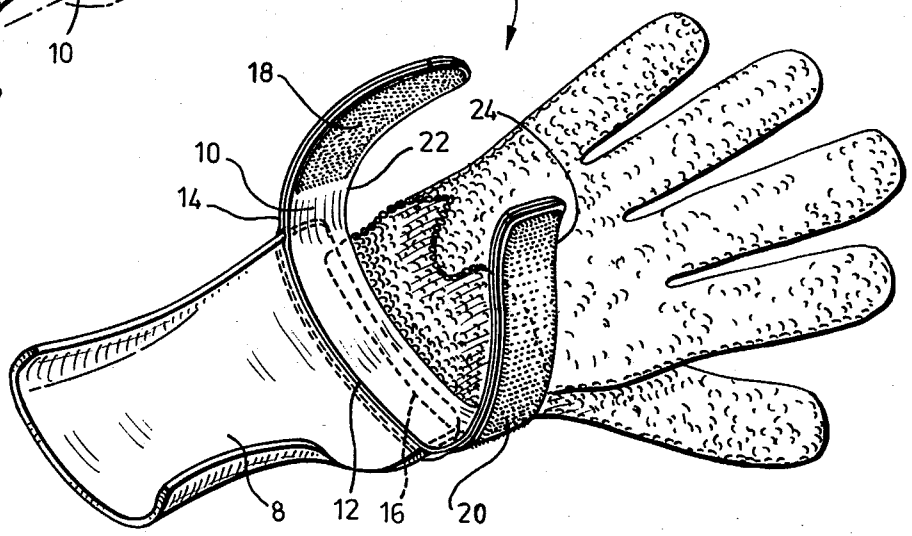

Referring first to FIG. 1, the glove 2 is shown as used in conjunction with a conventional rigid gauntlet 4 to protect the left hand and forearm of a user from misplaced strokes of a butcher's knife held in the right hand. The gauntlet may be moulded from tough acrylic synthetic plastics material. The glove itself has a glove portion 6 which is of similar conconstruction to conventional chain mesh butcher's gloves. Although the glove portion shown covers the full hand, known glove constructions in which two or three of the lesser fingers and associated parts of the hand are unprotected may also be used to form the glove portion if the reduced protection is acceptable. The glove would normally be worn in conjunction with fabric under and over gloves, but these are not shown as they would merely obscure the details of the invention.

It will be seen that, were the glove portion 6 and the gauntlet 4 used alone, there is a gap at the wrist between the glove and the gauntlet which can be entered by the end of a knife. Such entry, although fairly rare, can result in very serious injury to the wrist and adjacent parts of the forearm at the front and the base of the thumb. It is not possible simply to link the glove to the gauntlet; not only would it be difficult to put on such an assembly, but it would interfere unduly with articulation of the wrist. More sophisticated forms of armoured articulated joint between the glove portion and gauntlet would costly and heavy.

Instead, the glove of the invention incorporates a small wristguard 8 flexibly linked by a wrist band 10 to the glove portion. The wristguard is moulded to the shape of the wrist and is located so as to intercept and deflect knife strokes penetrating beneath the gauntlet 4. It is found that this function can be achieved using a shield which only partially surrounds the wrist and that portion of the forearm proximate the wrist joint. It is not necessary for more than about half the wrist and forearm to be surrounded, provided that the area protected includes the front of the wrist and adjacent part of the forearm and the area beneath the base of the thumb. Such a limited shield, provided with a flexible connection to the glove portion, does not significantly interfere with wrist articulation and yet provides the required protection. The wristband 10 fastens around the wrist to ensure proper placement of the wristguard and also ensures that the glove portion does not ride up the hand away from the gauntlet.

A suitable material for the wrist guard is rubberized fibre sheet material. This material is tough, light in weight, can be moulded to a desired shape and is readily bonded to other material. A sheet 0.1 inches thick provides more than adequate resistance to penetration by any knife stroke likely to reach it, particularly since any such stroke is likely to be glancing. The glove portion is arranged to overlap the shield slightly to avoid the risk of knife penetration through the connection between the two which formed by the wristband.

The wristband 10 in the embodiment shown is formed by two strips 12, 14 of rubber or other elastomeric material placed to either side of the lap 16 between the shield and the glove and then vulcanized to the shield, the glove and each other to form the band and provide a flexible connection between the glove portion and the wristband. Bonding may be achieved by the use of rubber solution, heat and pressure to form a vulcanized connection. The strips 12, 14 extend beyond the end of the lap 16 to form straps 22, 24 which may be fastened together to complete the wristband. A convenient form of fastening is provided by strips 18, 20 of hooked pile fabric suitably positioned on the straps 22, 24 and bonded to the material of the strips 12 and 14 respectively.

All of the materials and bonding techniques used should be able to withstand repeated application of sterilization temperatures so that the glove may be sterilized as required during use.

What I claim is:

1. A protective glove for butchers, comprising a chain mesh glove portion configured to cover at least the thumb and index finger of a wearer's hand, a semi-rigid wrist guard configured to shield the area extending not substantially more than half way around a user's forearm proximate the wrist joint, the shielded area including the front of the wrist and the area beneath the base of the thumb, and a flexible wrist band which both connects the wrist guard to the glove portion in overlapping relationship and is adapted to secure the glove around the wearer's wrist.

2. A glove according to claim 1, wherein the wrist band is of elastomeric material vulcanized to both the glove portion and to the wrist guard, the wrist guard being of rubberized fibre sheet moulded to the shape of the forearm portion to be protected.

3. A glove according to claim 2, wherein the wrist band is formed by two bands of elastomeric material, one to the outside and one to the inside of the overlap of the wrist guard and the glove portion, said strips being bonded to each other and to the material of the wrist guard and the glove portion, and the ends of the strips being provided with releasable fastening means.

4. A glove according to claim 3, wherein the releasable fastening means consist of strips of hooked pile fabric bonded to material of the strips.

5. A glove according to claim 2, 3 or 4, wherein all the materials used and the bonds between them are such as to withstand sterilizing temperatures.

* * * * *